US011166516B2

(12) United States Patent
Fraser et al.

(10) Patent No.: US 11,166,516 B2
(45) Date of Patent: Nov. 9, 2021

(54) ARTICLE OF FOOTWEAR HAVING AN UPPER THAT INCLUDES A KNITTED COMPONENT WITH A CUSHIONING REGION AND METHODS FOR FABRICATING THE SAME

(71) Applicant: NIKE, Inc., Beaverton, OR (US)

(72) Inventors: Katharine Fraser, Beaverton, OR (US); Adrian Meir, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 384 days.

(21) Appl. No.: 15/668,225

(22) Filed: Aug. 3, 2017

(65) Prior Publication Data

US 2018/0055137 A1 Mar. 1, 2018

Related U.S. Application Data

(60) Provisional application No. 62/380,035, filed on Aug. 26, 2016.

(51) Int. Cl.
*A43B 1/04* (2006.01)
*A43B 5/00* (2006.01)
(Continued)

(52) U.S. Cl.
CPC ..... *A43B 1/04* (2013.01); *A43B 5/002* (2013.01); *A43B 5/02* (2013.01); *A43B 5/06* (2013.01);
(Continued)

(58) Field of Classification Search
CPC .. D04B 1/243; D04B 1/22; D10B 2403/0113; D10B 2403/0241; D10B 2501/043; A43B 1/04; A43B 5/002; A43B 5/02; A43B 5/06; A43B 5/10; A43B 5/14; A43B 23/0215; A43B 23/028; A43B 23/042
(Continued)

(56) References Cited

U.S. PATENT DOCUMENTS 5,385,036 A * 1/1995 Spillane ..... A43B 1/04 2/16
5,746,013 A * 5/1998 Fay, Sr. ..... A43B 1/04 36/3 R
(Continued)

FOREIGN PATENT DOCUMENTS

CN 102534978 A 7/2012
CN 102560840 A 7/2012
(Continued)

OTHER PUBLICATIONS

International Preliminary Report on Patentability for corresponding PCT/US2017/045331 dated Feb. 26, 2019, 8 pages.
(Continued)

*Primary Examiner* — Danny Worrell
*Assistant Examiner* — Dakota Marin
(74) *Attorney, Agent, or Firm* — Shook, Hardy and Bacon LLP

(57) ABSTRACT

Articles for footwear, uppers for articles of footwear, and methods for fabricating articles of footwear are provided. In one example, an upper for an article of footwear includes a knitted component. The knitted component includes a plurality of knitted cushioning structures that define a cushioning region.

17 Claims, 10 Drawing Sheets

(51) Int. Cl.

| | |
|---|---|
| ***A43B 5/02*** | (2006.01) |
| ***A43B 5/06*** | (2006.01) |
| ***A43B 5/10*** | (2006.01) |
| ***A43B 5/14*** | (2006.01) |
| ***A43B 23/02*** | (2006.01) |
| ***A43B 23/04*** | (2006.01) |
| ***D04B 1/22*** | (2006.01) |
| *D04B 1/24* | (2006.01) |

(52) U.S. Cl.
CPC ..... *A43B 5/10* (2013.01); *A43B 5/14* (2013.01); *A43B 23/028* (2013.01); *A43B 23/0215* (2013.01); *A43B 23/042* (2013.01); *D04B 1/22* (2013.01); *D04B 1/243* (2013.01); *D10B 2403/0113* (2013.01); *D10B 2403/0241* (2013.01); *D10B 2501/043* (2013.01)

(58) Field of Classification Search
USPC ..... 66/177
See application file for complete search history.

(56) References Cited

U.S. PATENT DOCUMENTS

| | | | | |
|---|---|---|---|---|
| 6,063,473 | A * | 5/2000 | Zafiroglu | B29C 70/24 428/317.5 |
| 7,793,434 | B2 * | 9/2010 | Sokolowski | A43B 23/0235 12/146 C |
| 8,215,132 | B2 * | 7/2012 | Dua | A43B 1/04 66/177 |
| 8,312,646 | B2 * | 11/2012 | Meschter | A43B 3/26 36/45 |
| 8,490,299 | B2 * | 7/2013 | Dua | A43B 1/04 36/50.1 |
| 8,590,345 | B2 * | 11/2013 | Sokolowski | A43B 23/0235 66/177 |
| 8,745,895 | B2 * | 6/2014 | Sokolowski | A43C 1/04 36/50.1 |
| 8,800,172 | B2 * | 8/2014 | Dua | A43B 23/0235 36/50.1 |
| 8,839,532 | B2 * | 9/2014 | Huffa | A43B 1/04 36/45 |
| 8,844,167 | B2 * | 9/2014 | Greene | A43B 23/025 36/45 |
| 8,959,959 | B1 * | 2/2015 | Podhajny | A43B 1/04 66/177 |
| 8,997,529 | B1 * | 4/2015 | Podhajny | A43C 1/00 66/177 |
| 9,078,488 | B1 * | 7/2015 | Meir | A43B 1/04 |
| 9,226,540 | B2 * | 1/2016 | Podhajny | D04B 1/22 |
| 9,375,046 | B2 * | 6/2016 | Meir | A43B 23/0205 |
| 9,420,844 | B2 * | 8/2016 | Meir | D04B 1/123 |
| 9,637,847 | B2 * | 5/2017 | Terai | A43B 23/02 |
| 9,661,892 | B2 * | 5/2017 | Meir | D04B 1/108 |
| 9,681,704 | B2 * | 6/2017 | Podhajny | A43B 23/0205 |
| 9,907,349 | B2 | 3/2018 | Huffman et al. | |
| 9,936,757 | B2 * | 4/2018 | Podhajny | A43B 1/04 |
| 10,092,060 | B2 * | 10/2018 | Aveni | A43C 1/04 |
| 10,098,408 | B2 * | 10/2018 | Siegismund | A43B 5/06 |
| 10,172,422 | B2 * | 1/2019 | Podhajny | A43B 23/0245 |
| 10,294,592 | B2 * | 5/2019 | Uesato | A43B 7/34 |
| 10,306,946 | B2 * | 6/2019 | Zavala | A43B 1/04 |
| 10,368,606 | B2 * | 8/2019 | Meir | A43B 1/0018 |
| 10,383,388 | B2 * | 8/2019 | Podhajny | A43B 1/02 |
| 10,413,012 | B2 * | 9/2019 | Dojan | A43B 23/0235 |
| 2014/0134391 | A1 * | 5/2014 | Lumb | B32B 7/08 428/102 |
| 2014/0150292 | A1 | 6/2014 | Podhajny et al. | |
| 2014/0259285 | A1 * | 9/2014 | Andrews | A41D 19/01505 2/167 |
| 2016/0088893 | A1 | 3/2016 | Meir | |

FOREIGN PATENT DOCUMENTS

| | | |
|---|---|---|
| EP | 2474653 B1 | 9/2016 |
| TW | M518006 U | 3/2016 |

OTHER PUBLICATIONS

Office Action for corresponding Taiwan Application No. 106128026, dated Feb. 25, 2019, 12 pages.
International Search Report for corresponding PCT/US2017/045331 dated Nov. 21, 2017, 13 pages.
Office Action of Sri Lanka Application No. 20382, dated Dec. 27, 2019, 1 page.
Office Action of Indian Application No. 20382, dated Dec. 27, 2019, 1 page.
Office Action and English translation of relevant portions of Chinese Application No. 2017800493195, dated Jan. 2, 2020.
Office Action and English translation of relevant portion Chinese Application No. 2017800493195, dated Sep. 9, 2020, 15 pages.

* cited by examiner

Fig. 6
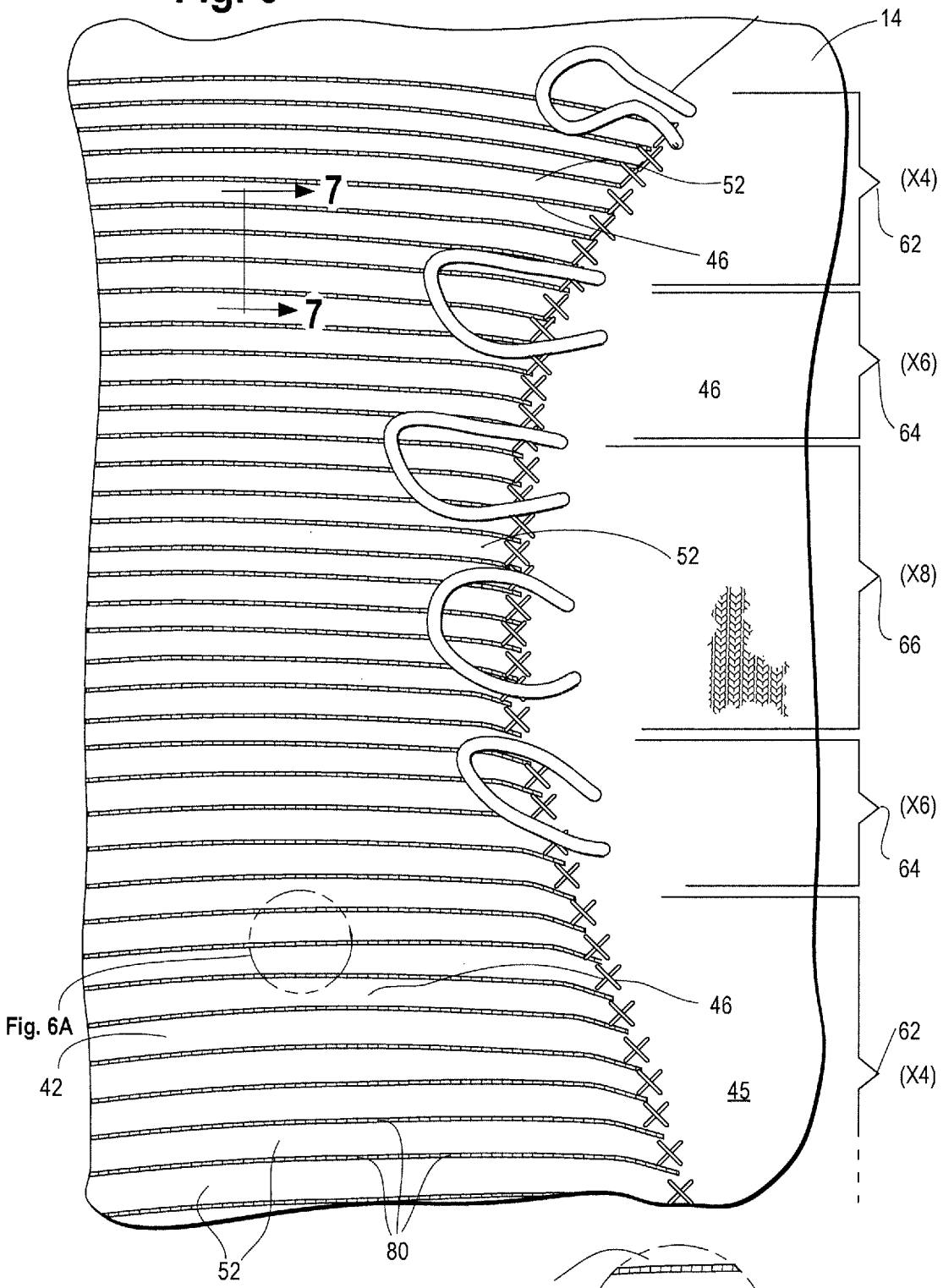
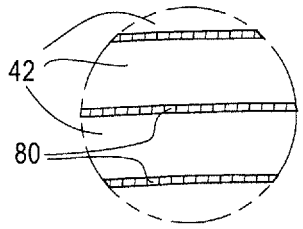
Fig. 6A

ARTICLE OF FOOTWEAR HAVING AN UPPER THAT INCLUDES A KNITTED COMPONENT WITH A CUSHIONING REGION AND METHODS FOR FABRICATING THE SAME

RELATED APPLICATIONS

This application claims the benefit of U.S. Provisional application No. 62/380,035 entitled "Articles of Footwear Having an Upper that Includes a Knitted Component With a Cushioning Region and Methods for Fabricating the Same" filed on Aug. 26, 2016, which is incorporated herein in its entirety.

TECHNICAL FIELD

The technical field relates generally to footwear, and more particularly relates to articles of footwear having an upper that includes a knitted component with a region that is configured to provide enhanced cushioning.

BACKGROUND

Conventional articles of footwear generally include an upper and a sole structure. The upper is secured to the sole structure and forms a void on the interior of the footwear for comfortably and securely receiving a foot of a wearer. Foot comfort is a factor considered by consumers of footwear. Accordingly, it is desirable to provide articles of footwear having an upper with enhanced foot cushioning and methods for fabricating such footwear.

SUMMARY

Articles for footwear, uppers for articles of footwear, and methods for fabricating articles of footwear are provided herein. In an exemplary embodiment, an upper for an article of footwear includes a knitted component. The knitted component includes a plurality of knitted cushioning structures that define a cushioning region.

In an exemplary embodiment, an article of footwear is provided. The article of footwear includes a sole structure and an upper secured to the sole structure. The upper includes a knitted component that includes a plurality of knitted cushioning structures that define a cushioning region.

In accordance with an exemplary embodiment, a method for fabricating an article of footwear is provided. The method includes forming an upper comprising a knitted component. The upper is formed by knitting a plurality of cushioning tubes that define a cushioning region of the knitted component.

Further objects, features, and advantages of the invention will become apparent to those skilled in the art to which the present invention relates from consideration of the following description and the appended claims, taken in conjunction with the accompanied drawings.

DESCRIPTION OF THE DRAWINGS

The drawings described herein are for illustration purposes only and are not intended to limit the scope of the present disclosure in any way. In the drawing figures, like numerals denote like elements.

FIG. 6 illustrates an enlarged top view of a portion of the knitted component including the cushioning region depicted in FIG. 5;

FIG. 6A is an enlarged view of a portion of FIG. 6.

DETAILED DESCRIPTION

The following description is merely exemplary in nature and is not intended to limit the present disclosure or its application or uses.

Figure 1:
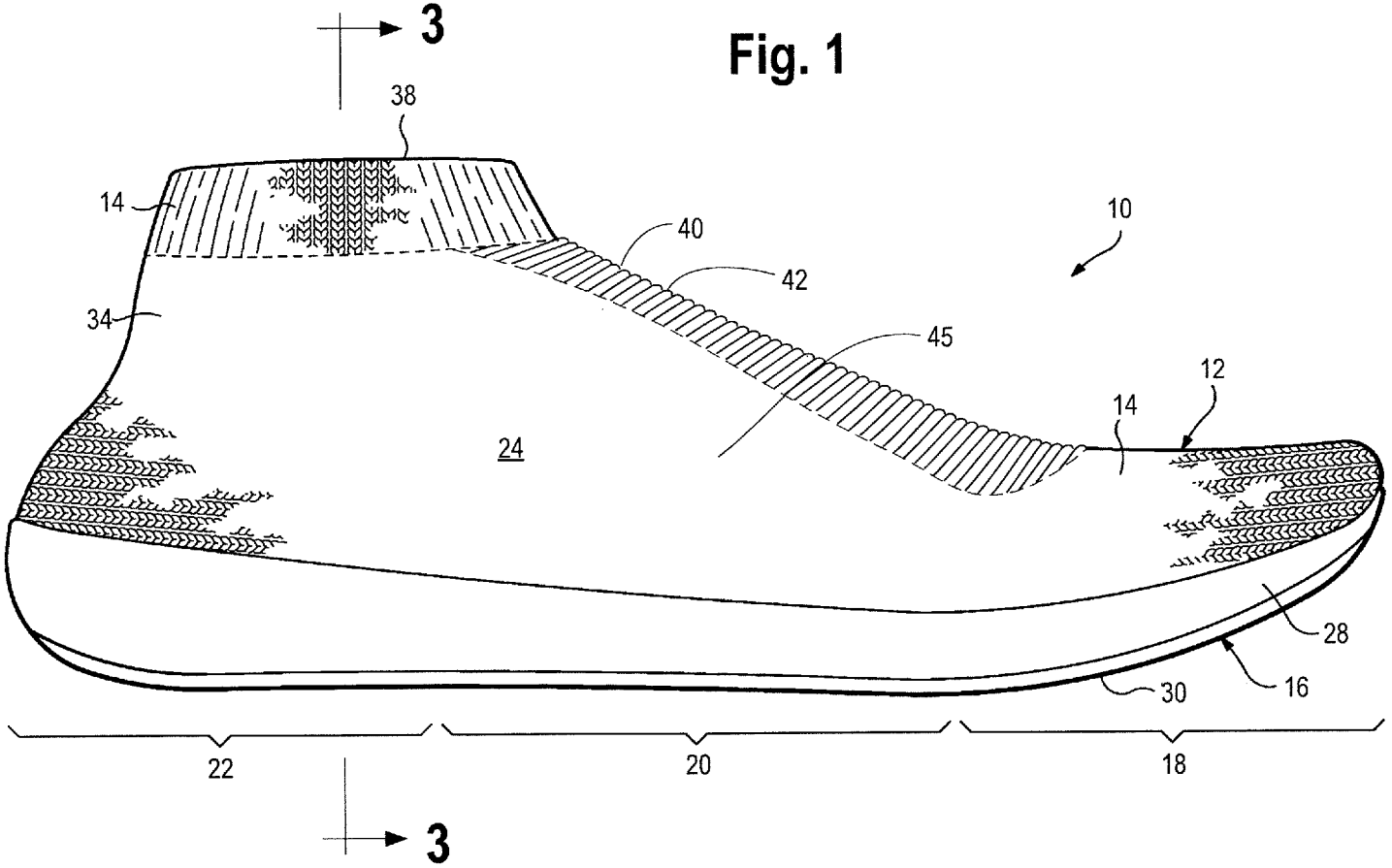
FIG. 1 illustrates a lateral side view of an article of footwear in accordance with an exemplary embodiment.
Figure 2:
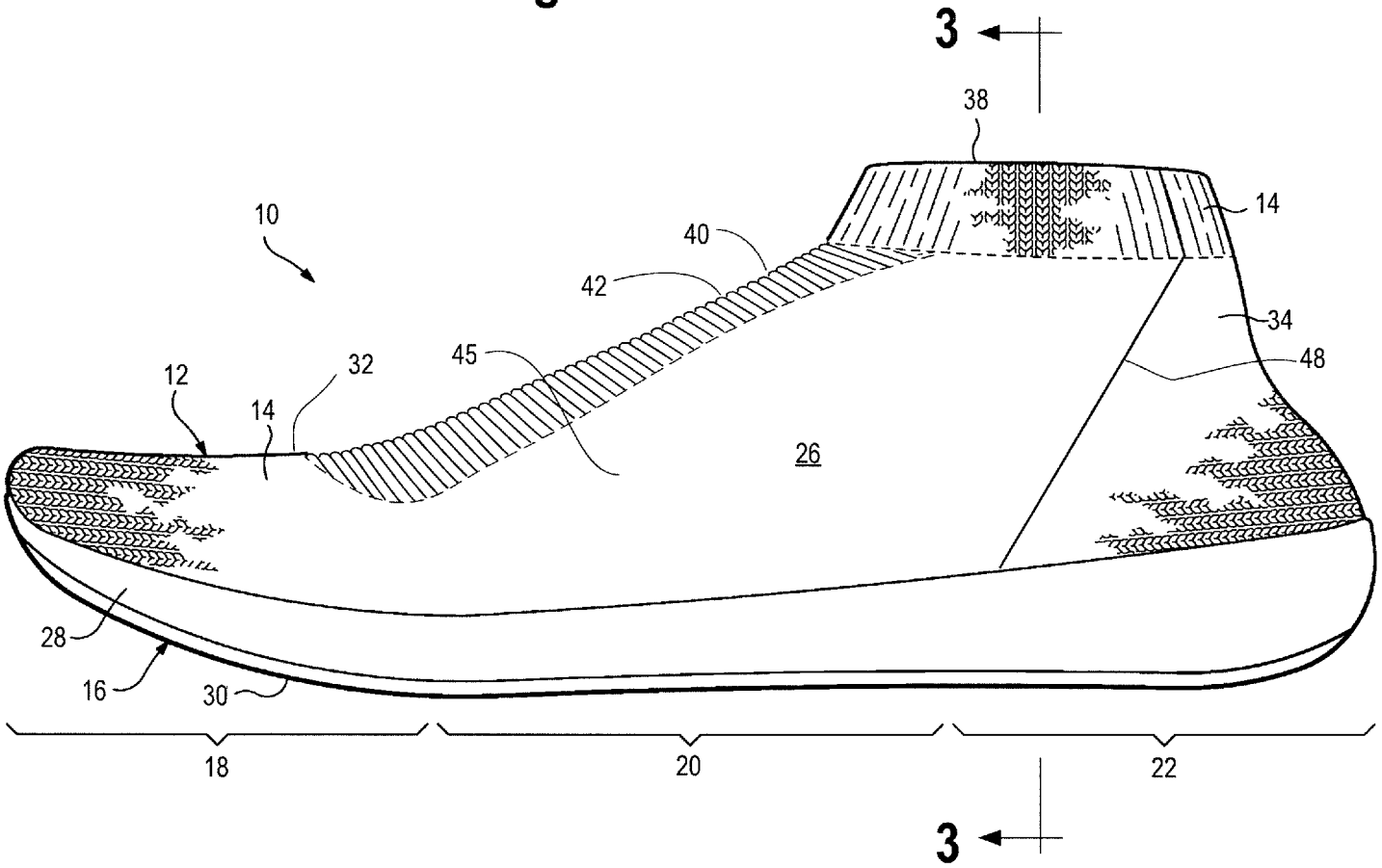
FIG. 2 illustrates a medial side view of an article of footwear in accordance with an exemplary embodiment.
Figure 3:
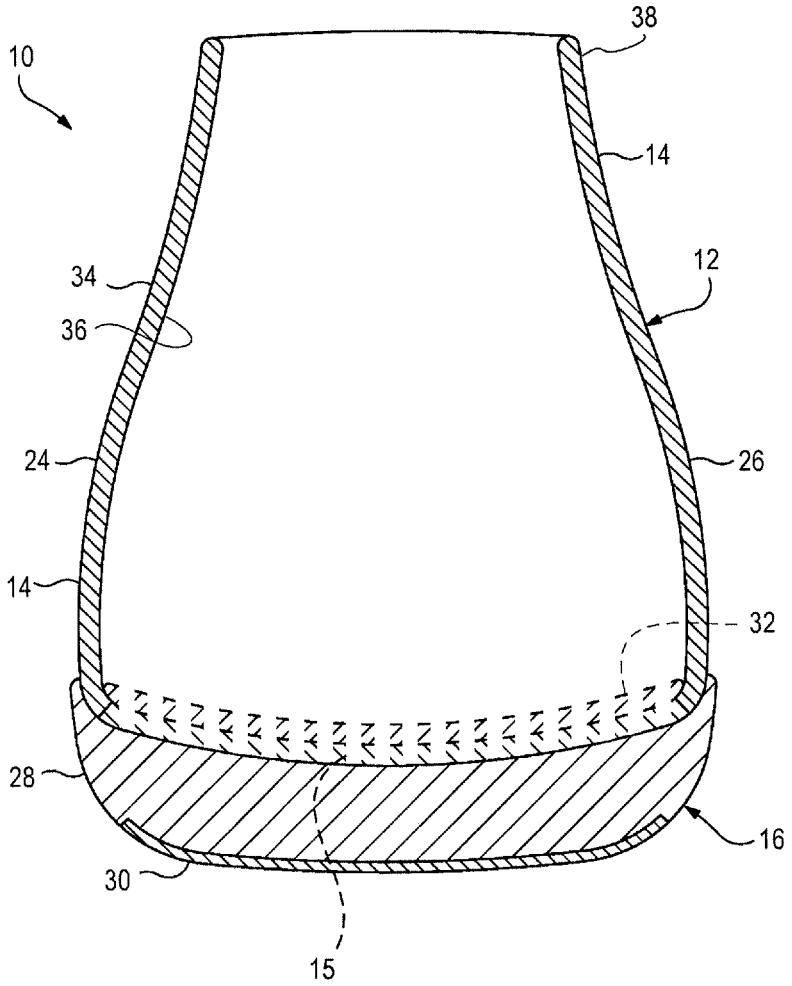
FIG. 3 illustrates a cross-sectional view of the article of footwear depicted in FIG. 1 along line 3-3.

Referring now to the drawings, FIGS. 1-3 illustrate an example of an article of footwear 10 having an upper 12 formed at least primarily of a knitted component 14. The article of footwear 10 has a general configuration suitable for walking or running and may also be applied to a variety of other athletic footwear types, including baseball shoes, basketball shoes, cross-training shoes, cycling shoes, football shoes, soccer shoes, sprinting shoes, tennis shoes, and hiking boots, for example. Alternatively, the article of footwear 10 may also be applied to footwear types that are generally considered to be non-athletic, including dress shoes, loafers, sandals, and work boots.

Figure 5:
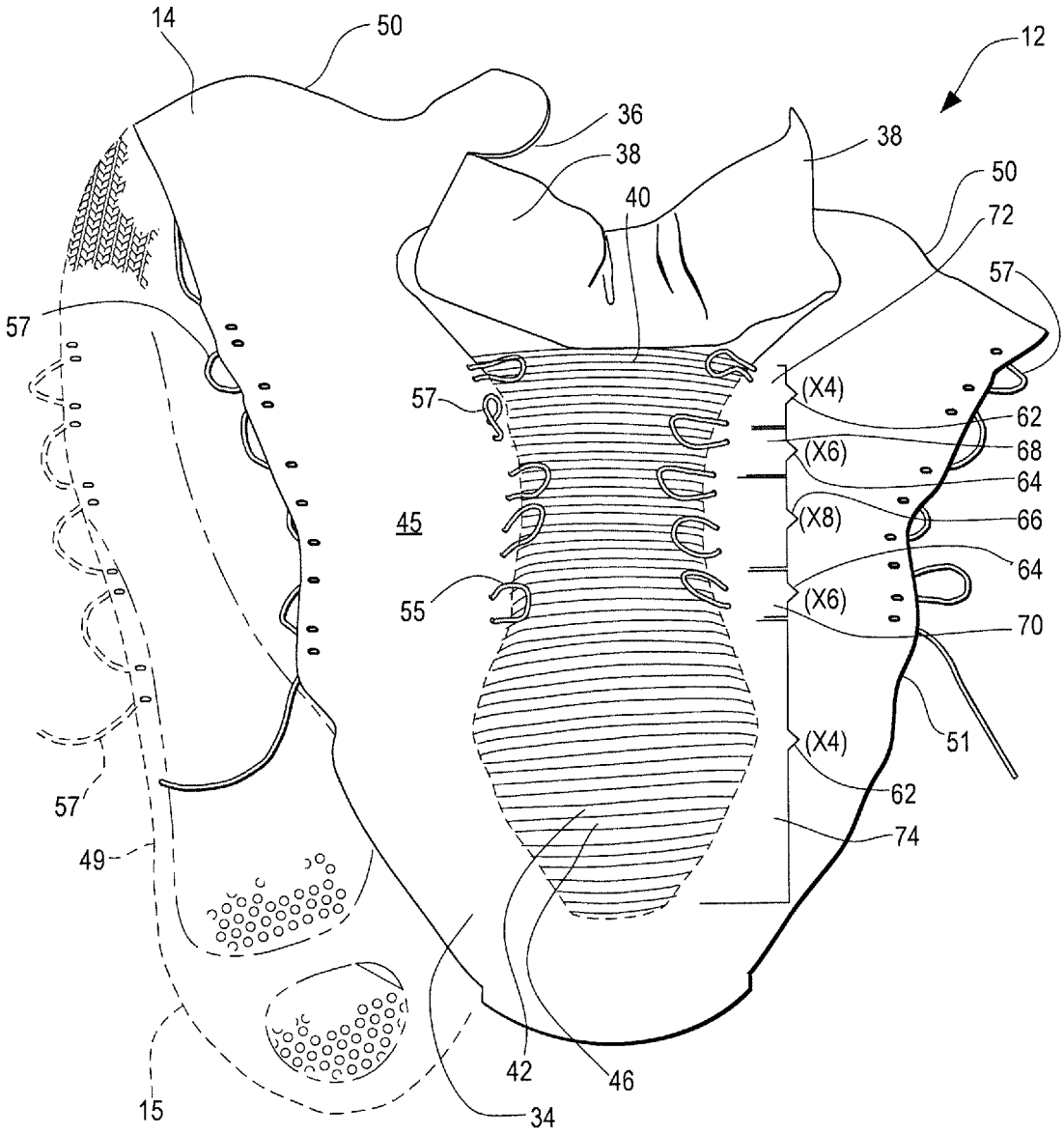
FIG. 5 illustrates a perspective top view of an upper including a knitted component with a cushioning region in accordance with an exemplary embodiment.

As illustrated in FIGS. 3 and 5, for example, the upper 12 of the article of footwear 10 may also include an underfoot portion 15 (indicated in the figures by dashed lines) which is generally located between the foot of a wearer and a ground surface when the footwear 10 is assembled and configured to receive the foot of a wearer. In other words, the underfoot portion 15 may be associated with a plantar aspect of the foot (also known as the sole or bottom of a foot) and the remainder of the upper 12 may be configured to correspond with an overfoot portion associated with the remainder of the foot, including the dorsal surface (i.e., the top of the foot). The underfoot portion may extend from a lateral side 24 of the upper 12 to a medial side 26 of the upper 12 and from a toe or forefoot region 18 to a heel region 22.

The underfoot portion 15 may include one or more desirable characteristics such as suitable strength, durability, flexibility, water permeability, stretchability, and the like. Since the underfoot portion 15 may bear the weight of the wearer when in use, the underfoot portion 15 of the upper 12 may be particularly thick and/or dense with respect to other locations of the upper 12 to provide a relatively high degree of support, durability, protection and even cushioning between the ground and the plantar aspect of the foot.

The upper 12, and particularly the underfoot portion 15, if present, may be configured to attach to a sole structure 16. The underfoot portion 15 may be joined to a sole structure 16 using any suitable technique, such as through the use of an adhesive, by sewing, bonding, welding, etc. The sole structure 16 may be any suitable type of sole structure, and may form an outsole 30 configured to contact the ground when in use. The sole structure 16 may have a bottom surface configured for a particular activity. For example, the sole structure 16 may include one or more cleats configured to provide sufficient traction on a grass field and/or an artificial turf field during an athletic event (e.g., a football, soccer, or baseball game). In other embodiments, the sole structure 16 may have treads or other features suitable for use in a walking shoe, a running shoe, an indoor or outdoor athletic shoe, a loafer, etc. It is contemplated that another component, such as a separate midsole, could be placed between the sole structure 16 and the underfoot portion 15 of the upper 12, but this is not required. It is also contemplated that the underfoot portion 15 of the upper 12, if present, may include a surface configured to directly contact the ground when the article of footwear 10 is in use such that the separate sole structure 16 is not necessary. For example, the underfoot portion 15 may be sufficiently strong, durable, and protective to serve as the bottom terminal surface of the article of footwear 10, thereby eliminating the need for a separate sole structure 16.

As shown in FIG. 3, the underfoot portion 15 is attached to the sole structure 16. The sole structure 16 is located under and supports a foot of a wearer, and the upper 12 provides a comfortable and secure covering for the foot. As such, the foot of the wearer may be located within a void formed by upper 12 to effectively secure the foot within the article of footwear 10 or otherwise unite the foot and the article of footwear 10. Moreover, the sole structure 16 is secured to a lower area of the upper 12 and extends between the foot and the ground to attenuate ground reaction forces (e.g., cushion the foot), provide traction, enhance stability, and influence the motions of the foot, for example.

The article of footwear 10 may be divided into three general regions: the forefoot region 18, a midfoot region 20, and the heel region 22. The forefoot region 18 generally encompasses portions of the article of footwear 10 corresponding with forward portions of the foot, including the toes and joints connecting the metatarsals with the phalanges. The midfoot region 102 generally encompasses portions of the article of footwear 10 corresponding with middle portions of the foot, including an arch area. The heel region 103 generally encompasses portions of the article of footwear 10 corresponding with rear portions of the foot, including the heel and calcaneus bone.

The article of footwear 10 also includes the lateral side 24 and the medial side 26 that extend through each of the regions 18, 20, and 22 and correspond with opposite sides of the article of footwear 10. In one example, the lateral side 24 corresponds with an outside area of the foot (e.g., the surface that faces away from the other foot), and the medial side 26 corresponds with an inside area of the foot (e.g., the surface that faces toward the other foot). The regions 18, 20, and 22 and the sides 24 and 26 are not intended to demarcate precise areas of the article of footwear 10. Rather, the regions 18, 20, and 22 and the sides 24 and 26 are intended to represent general areas of the article of footwear 10 to aid in the following discussion. In addition to the article of footwear 10, the regions 18, 20, and 22 and the sides 24 and 26 may also be applied when referencing the sole structure 16, the upper 12, and individual elements thereof.

With continuing reference to FIGS. 1-3, in an exemplary embodiment, the sole structure 16 includes a midsole 28, an outsole 30, and an optional sockliner 32. The midsole 28 is secured to a lower surface of the upper 12 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, the midsole 28 may incorporate plates, moderators, fluid-filled chambers, lasting elements, or motion control members that further attenuate forces, enhance stability, or influence the motions of the foot, or the midsole 28 may be primarily formed from a fluid-filled chamber. The outsole 30 is secured to a lower surface of midsole 28 and may be formed from a wear-resistant rubber material that is textured to impart traction. The sockliner 32, if present, is located within the void in the upper 12 and is positioned to extend under a lower surface of the foot to enhance the comfort of the article of footwear 10. Sole structure configurations may vary considerably and therefore, it is to be understood that other configurations for sole structure 16 may be used in connection with the upper 12.

As illustrated, the upper 12 including the knitted component 14 extends through each of the regions 18, 20, and 22, along both the lateral and medial sides 24 and 26, over the forefoot region 18, around heel region 22, and, as shown in FIG. 3, over an upper surface of the sole structure 16. When the foot is located within the void, which is shaped to accommodate the foot, the upper 12 extends along a lateral side of the foot, along a medial side of the foot, over the foot, around the heel, and, in some embodiments as described above, the upper may also be configured to extend under the foot. The upper 12 includes an exterior surface 34 and an opposite interior surface 36. Whereas the exterior surface 34 faces outward and away from the article of footwear 10, the interior surface 36 faces inward and defines a majority or a relatively large portion of the void in the upper 12. Moreover, the interior surface 36 may lie against the foot or a sock covering the foot of the wearer. The upper 12 also includes a collar 38 that is at least partially located in the heel region 22 and defines an opening to the void in the upper 12, thereby providing the foot with access to the void. That is, the foot may be inserted into the upper 12 and withdrawn from upper 12 through the opening formed by collar 38.

The knitted component 14 of the upper 12 is shown having a throat 40 that extends from the collar 38, between and/or from the lateral and medial sides 24 and 26, and over the midfoot region 20 and the forefoot region 18. In an exemplary embodiment, the knitted component 14 includes a cushioning region 42 that may be arranged and located, for example, at least partially in the throat 40 of the upper 12 surrounded by a peripheral region 45. In one example, the cushioning region 42 provides enhanced cushioning to an upper area or the top of the foot of the wearer that is adjacent to (e.g., underlies) the cushioning region 42. In another example and as will be discussed in further detail below, the cushioning region 42 provides enhanced cushioning in an area of the upper 12 that may abut and/or otherwise interface with a lace(s) 43 (shown in FIG. 4) or other securement or attachment mechanisms, including but not limited to straps, ties, hooks, elastics, toggles and the like, or a combination thereof, that are used to tighten and secure the article of footwear 10 to the foot of the wearer.

In one non-limiting example, the cushioning region may distribute and/or absorb localized tension, compression, force and/or pressure from the lace(s) 43 (or other securement mechanisms) so as to minimize and/or reduce the transferring of these forces from the lace(s) 43 (or other securement mechanisms) to the upper area of the foot of the wearer. Although the cushioning region 42 is illustrated as being formed in the throat 40 of the knitted component 14, it is to be understood that the cushioning region 42 may be located in another region or regions of the knitted component 14. For example, the cushioning region 42 may be disposed primarily on the lateral side 24 and/or on the medial side 26 of the knitted component 14 to provide additional cushioning to corresponding areas of the foot of the wearer. Additionally or alternatively, one or more cushioning regions 42 may also be located in the forefoot region 18, the heel region 22 or any other portion of the upper 12 where enhanced cushioning may be advantageous or desirable.

In an exemplary embodiment and as described in further detail below, the cushioning region 42 is configured as a plurality of cushioning structures. In one example and as illustrated in the figures, the plurality of cushioning structures each has a tube-like configuration. The tube-like structures may be expanded, lofted, swollen or otherwise enlarged configurations that are formed through a knitting process (e.g., knitted cushioning structures 46). The knitted cushioning structures are constructed and configured to proportionately yield or collapse under an applied force and recover when the applied force is alleviated to provide a cushioning effect. In one example and as illustrated, the knitted cushioning structures 46 are shown as generally elongated tubes that are arranged side-by-side (e.g., juxtaposed) or substantially parallel to each other extending generally horizontally across the throat 40 of the knitted component 14 from the lateral side 24 to the medial side 26. It is also contemplated that the knitted cushioning structures 46 can be other shapes and/or configurations that are oriented in various other patterns, directions or arrangements.

FIG. 5 is a perspective top view of one example of a knitted component 14 formed through a knitting process and prior to being shaped into a three-dimensional structure that is configured to receive a foot and prior to being secured to any sole structure 16 in accordance with an exemplary embodiment. Referring to FIGS. 1-3 and 5, the cushioning region 42 is produced during fabrication of the knitted component 14. In particular, the knitted component 14 is formed through a knitting process and extends throughout the upper 12. In one example, a seam 48 extends through the heel region 22 on the medial side 26 to join the edges 50 of the knitted component 14. In another example, in an upper 12 that is fabricated to include an underfoot portion 15, an alternative or additional seam may be present that attaches an edge 49 of the underfoot portion 15 to edge 51 of either lateral or medial side 24 or 26 of the upper 12 to form a void that is configured to receive a foot.

The upper 12 may also include one or more additional or optional features that may serve functional and/or aesthetic purposes including but not limited to the attachment mechanisms or lace(s) 43 (shown in FIG. 4) mentioned above that assists with tightening the upper 12 around the foot, a heel counter in heel region 22 for enhancing stability, a toe guard in forefoot region 18 that is formed of a wear-resistant material, and/or logos, trademarks, and placards with care instructions and material information. Accordingly, the upper 12 may incorporate a variety of other features and elements, in addition to the features and elements discussed herein and shown in the figures.

Seams may be present in one or more areas of the knitted component 14 as described above. It is also contemplated that the knitted component 14 may be formed as an integral one-piece element during a knitting process, such as a weft knitting process (e.g., with a flat knitting machine or circular knitting machine), a warp knitting process, or any other suitable knitting process. That is, the knitting process may substantially form the knit structure of the knitted component 14 without the need for significant post-knitting processes or steps. Alternatively, two or more portions of the knitted component 14 may be formed separately as integral one-piece elements and then the respective elements attached. In some embodiments, the knitted component 14 may be shaped after the knitting process to form and retain the desired shape of the upper (for example, by using a foot-shaped last). The shaping process may include attaching the knitted component 14 to another object (e.g., a strobel) and/or attaching one portion of the knitted component 14 to another portion of the knitted component 14 at one or more seams as previously mentioned by sewing, by using an adhesive, by bonding or by another suitable attachment process.

Forming the upper 12 with the knitted component 14 may provide the upper 12 with advantageous characteristics including, but not limited to, a particular degree of elasticity (for example, as expressed in terms of Young's modulus), breathability, bendability, strength, moisture absorption, weight, and abrasion resistance. These characteristics may be accomplished by selecting a particular single layer or multi-layer knit structure (e.g., a ribbed knit structure, a single jersey knit structure, or a double jersey knit structure), by varying the size and tension of the knit structure 14, by using one or more yarns formed of a particular material (e.g., a polyester material, or an elastic material such as spandex) or construction (e.g., multifilament or monofilament), by selecting yarns of a particular size (e.g., denier), or a combination thereof. The knitted component 14 may also provide desirable aesthetic characteristics by incorporating yarns having different colors, textures or other visual properties arranged in a particular pattern. The yarns themselves and/or the knit structure formed by one or more of the yarns of the knitted component 14 may be varied at different locations such that the knitted component 14 has two or more portions with different properties (e.g., a portion forming the throat area 40 of the upper 12 and/or a portion forming the collar 38 may be relatively elastic while another portion may be relatively less elastic or inelastic). In some embodiments, the knitted component 14 may incorporate one or more materials with properties that change in response to a stimulus (e.g., temperature, moisture, electrical current, magnetic field, or light). For example, the knitted component 14 may include yarns formed of a thermoplastic polymer material (e.g., polyurethanes, polyamides, polyolefins, and nylons) that transitions from a solid state to a softened or liquid state when subjected to certain temperatures at or above its melting point and then transitions back to the solid state when cooled. The thermoplastic polymer material may provide the ability to heat and then cool a portion of the knitted component 14 to thereby form an area of bonded or continuous material that exhibits certain advantageous properties including a relatively high degree of rigidity, strength, and water resistance, for example.

Figure 4:
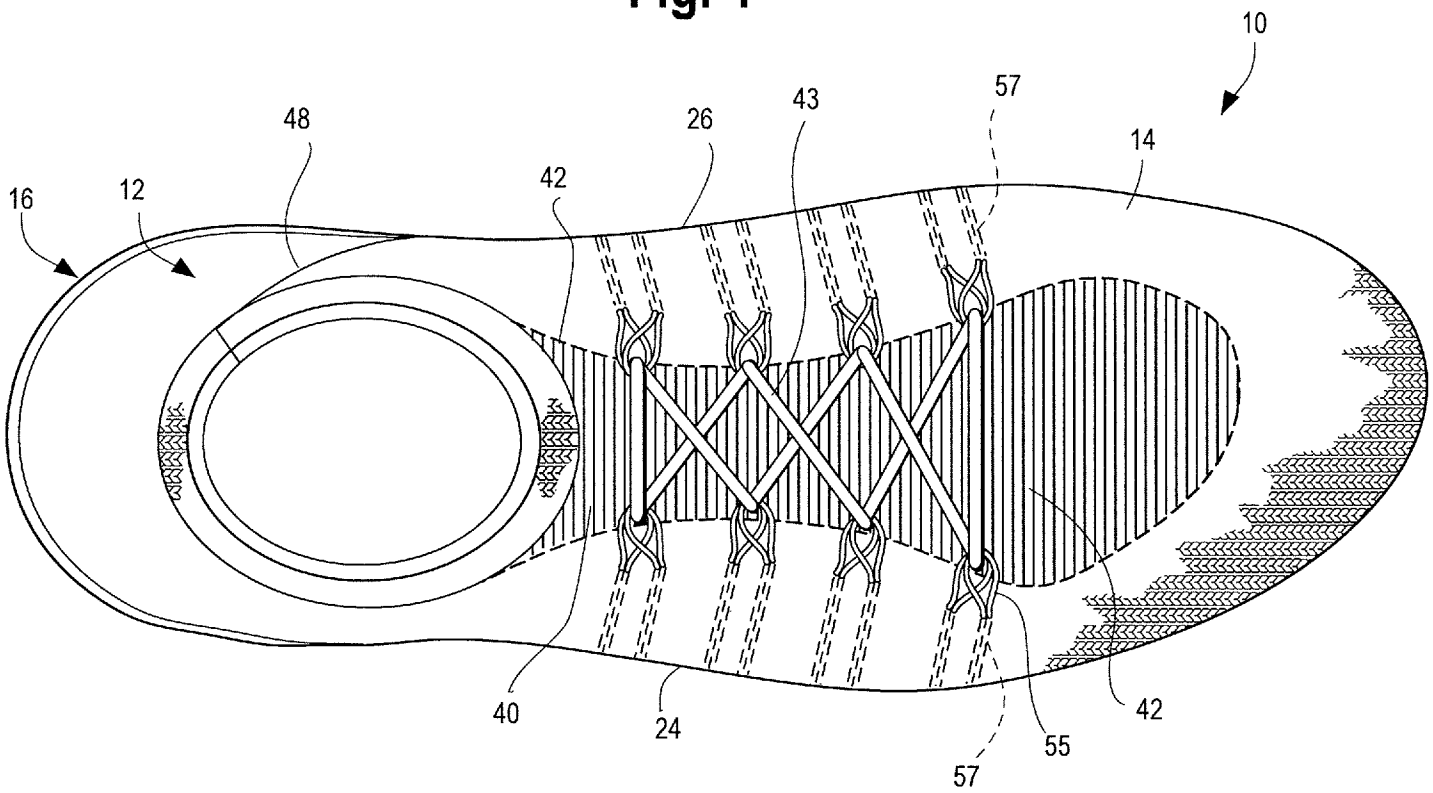
FIG. 4 illustrates a top view of an article of footwear in accordance with an exemplary embodiment.

In some embodiments and as illustrated in FIGS. 4 and 5, the knitted component 14 may include one or more yarns or strands that are at least partially inlaid or otherwise inserted within the knit structure of the knitted component 14 during or after the knitting process, herein referred to as "tensile strands" 57. The tensile strands 57 may be substantially inelastic so as to have a substantially fixed length. The tensile strands 57 may extend through a plurality of courses of the knitted component 14 or through a passage formed within the knitted component 14 and may limit the stretch of the knitted component 14 in at least one direction. For example, the tensile strands 57 may extend from an area in the underfoot portion 15, and/or approximately from a biteline of the upper 12 to a throat area 40 of the upper 12 to limit the stretch of the upper 12 in the lateral direction. The tensile strands 57 may form one or more lace apertures 55 for receiving a lace 43 and/or may extend around at least a portion of a lace aperture 55 formed in the knit structure of the knitted component 14.

Referring to FIGS. 5-7B, in an exemplary embodiment and as discussed above, the cushioning region 42 including the knitted cushioning structures 46 are preferably knitted during knitting of the knitted component 14. In particular, each of the knitted cushioning structures 46 is formed having a knitted wall 52 surrounding a channel 54. One or more strands 56 extend longitudinally through the channel 54. In an exemplary embodiment, each of the strands 56 are intermittently coupled or "tucked" by one or more knitted tuck stitches to the knit structure on opposing sides 58 and 60 of the knitted wall 52 throughout the length of the tube-like or elongated channel 54. In an exemplary embodiment, it has been found that by intermittently tucking the strands 56 to the opposing sides 58 and 60 of the knitted walls 52, the strands 56 form a "scaffolding-like structure" that supports and maintains the expanded and lofted shape, structure and profile of the knitted cushioning structures 46 and maintain a substantially open volume of the channel 54, thus resulting in an enhanced cushioning when a force is applied to one or more of the knitted cushioning structures 46 within the cushioning region 42.

In an exemplary embodiment, each of the knitted cushioning structures 46 may have multiple strands 56 extending there through, such as at least two strands 56, and in some embodiments the knitted cushioning structures 46 may comprise from four strands to eight strands 56 extending longitudinally through any one or more of the respective channel(s) 54. Moreover, the cushioning region 42 may include different areas, where each area contains a different set(s) of knitted cushioning structures 46 with different numbers of strands 56 extending through the respective channels 54 in each set. It has been found that the number of strands 56 extending through each respective the knitted cushioning structure 46 can affect the outer profile of the individual knitted cushioning structure 46, with a greater number of strands 56 within the channel 54 providing a channel with a relatively greater diameter. The number of strands 56 extending through the channel 54 of the knitted cushioning structure 46 may also result in a relatively greater amount of enhanced cushioning provided by the knitted cushioning structure 46.

In one example, the cushioning region 42 includes a first set 62 of knitted cushioning structures 46, a second set 64 of knitted cushioning structures 46 and a third set 66 of knitted cushioning structures 46. The respective sets 62, 64 and 66 are identified by brackets in exemplary FIGS. 5 and 6. The respective sets 62, 64 and 66 each contain at least one knitted cushioning structure 46 in the set and more preferably, the respective sets 62, 64 and 66 each contain two or more knitted cushioning structures 46 in each set. The respective sets 62, 64 and 66 may each contain the same number of knitted cushioning structures 46 or they may contain different numbers of knitted cushioning structures 46.

As FIG. 5 illustrates, each of the knitted cushioning structures 46 in the first set 62 has a first number of strands 56, for example four strands 56, extending longitudinally through the respective channel 54 of each of the knitted cushioning structures 46. Each of the knitted cushioning structures 46 in the second set 64 has a second number of strands 56, for example six strands 56, extending longitudinally through the respective channel 54 of each of the knitted cushioning structures 46. Each of the knitted cushioning structures 46 in the third set 66 has a third number of strands 56, for example eight strands, extending longitudinally through the respective channel 54.

As illustrated, the cushioning region 42 is configured such that the third set 66 of knitted cushioning structures 46 is disposed between a first portion 68 and a second portion 70 containing the second set 64 of the knitted cushioning structures 46. In other words the third set 66 of knitted cushioning structures (which contain eight strands extending through the channel 54 of each knitted cushioning structure 46) is disposed between two separate sets 64 of knitted cushioning structures 46 (which each contain six strands extending through the channel 54 of each knitted cushioning structure 46). A first portion 72 and a second portion 74 containing the first set 62 of the knitted cushioning structures 46 are disposed adjacent to the first and second portions 68 and 70 containing the second set 64 of the knitted cushioning structures 46, respectively (e.g., on sides opposite the third set 66 of the knitted cushioning structures 46). In this example, it is been found that the third set 66 of the knitted cushioning structures 46 has greater "loft" or enhanced cushioning than the second set 64 of the knitted cushioning structures 46, and the second set 64 of the knitted cushioning structures 46 has greater "loft" or enhanced cushioning than the first set 62 of the knitted cushioning structures 46 due to the number of strands 56 extending through the channel 54 of each of the knitted cushioning structures 46. For example, a greater number of strands 56 extending through the channel 54 of a knitted cushioning structure 46 results in greater loft and enhanced cushioning than a knitted cushioning structure 45 having fewer strands 56 extending through the channel 54.

Figure 7A:
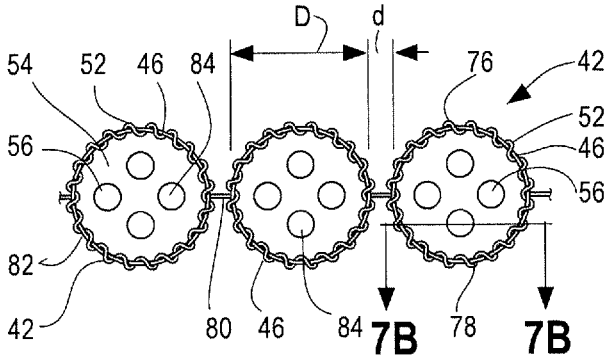
FIG. 7A illustrates a cross-sectional view of a portion of the cushioning region depicted in FIG. 6 along line 7-7 in accordance with one embodiment.
Figure 7B:
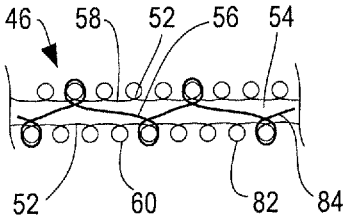
FIG. 7B illustrates a cross-sectional view of a portion of the cushioning region depicted in FIG. 7A along line 7B-7B.

As illustrated in FIG. 7A, some or all of the knitted walls 52 of the knitted cushioning structures 46 may be configured as substantially circular knitted tube walls 52. In other words, a cross-section of a single knitted cushioning structure 46 may have a generally round or circular shape, although it is also contemplated that the cross-section may appear oval or egg-shaped. In this example, the knitted walls 52 are substantially symmetrical in which an exterior facing wall portion 76 (e.g., forming part of the exterior surface 34) and an interior facing wall portion 78 (e.g., forming part of the interior surface 36) have substantially the same outer profile shape and form substantially similar cushioning volumes. This structure may be formed by knitting by a "tubular stitch" and/or other known or suitable stitch types including but not limited to an "ottoman" type stitch, with the number of courses on one knitting bed (i.e., a front bed) being the same or substantially the same as the number of courses on the other bed (i.e., a back bed).

Figure 7C:
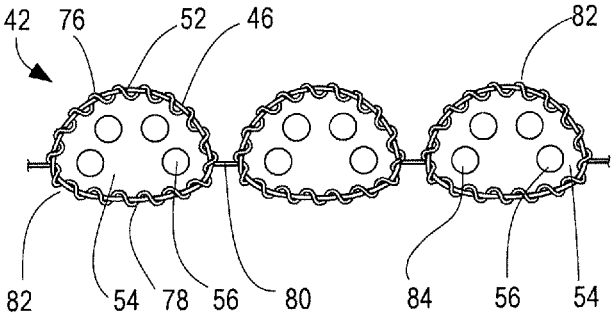
FIG. 7C illustrates a cross-sectional view of the cushioning region depicted in FIG. 6 along line 7-7 in accordance with another embodiment.

Alternatively and as illustrated in FIG. 7C, some or all of the knitted walls 52 may be configured as asymmetric knitted tube walls 52. In this example, the knitted walls 52 are substantially asymmetrical, for example, in which the exterior facing wall portion 76 has greater outer profile shape than the interior facing wall portion 78 such that the cushioning volume defined by the exterior facing wall portion 76 is greater than the interior facing wall portion 78. This structure may also be preferably formed by knitting by a tubular stitch, with the number of courses forming the exterior facing wall portion 76 being greater than the number of courses that form the interior facing wall portion 78.

Referring to FIGS. 5-7C, as illustrated, the knitted cushioning structures 46 may be connected to adjacent knitted cushioning structures 46 by transverse strands 80 (e.g., monofilament yarn). In an exemplary embodiment, the distance (d) between adjacent knitted cushioning structures 46 is from about 0.01 to about 0.3 mm. In an exemplary embodiment, the knitted cushioning structures 46 each have a diameter or maximum cross-sectional dimension (D) of from about 0.5 to about 5 mm, such as from about 0.5 to about 3 mm, for example from about 1 to about 2 mm.

The knitted component 14 forming the upper 12 may incorporate various types and combinations of stitches and yarns. With regard to stitches, the yarn forming knitted component 14 may have one type of stitch in one area of the knitted component 14 and another type of stitch in another area of the knitted component 14. Depending upon the types and combinations of stitches utilized, areas of the knitted component 14 may have a plain knit structure, a mesh knit structure, or a rib knit structure, for example. In an exemplary embodiment and as will be discussed in further detail below, the cushioning region 42 of the knitted component 14 may be formed using the tubular type stitch mentioned above, although any other suitable stitch type may be used as necessary or desired.

With regard to yarns, types of yarn that may be used include, but are not limited to, filament yarns and spun yarns. Filament yarns are formed of continuous filaments which can be twisted or grouped together. Monofilament yarn is formed of a single long, continuous filament. Spun yarn is made by twisting staple fibers together to make a cohesive strand. The process of forming a yarn from staple fibers typically includes carding and drawing the fibers to form sliver, drawing out and twisting the sliver to form roving, and spinning the roving to form a strand. Multiple strands can be plied (twisted together) to make a thicker yarn. The twist direction of the staple fibers and of the plies can affect the final properties of the yarn. Spun yarns can contain a single type of fiber, or can be made from a blend of fibers. Similarly, filament yarns can contain filaments of a single type, or can be formed using multiple types of filaments. Once formed, filament and spun yarns can undergo further treatments such as dyeing, texturizing, or coating with a material such as a synthetic polymer.

In one example, the knitted component 14 may have one type of yarn in one area of the knitted component 14 and another type of yarn in another area of the knitted component 14. Depending upon various design criteria, the knitted component 14 may incorporate yarns with different deniers, materials (e.g., cotton, elastane, polyester, rayon, wool, and nylon), and degrees of twist, for example. The different types of yarns may affect the physical properties of the knitted component 14 including aesthetics, stretch, thickness, air permeability, and abrasion-resistance. In one example, the cushioning region 42 is formed from a first yarn 82 that forms the knitted walls 52 of the knitted cushioning structures 46 and a second yarn 84 that comprises the strands 56 that extend within the respective channels 54 of the knitted cushioning structures 46. In an exemplary embodiment, the first yarn 82 is a multi-strand yarn, such as, for example, a yarn formed of two strands of textured polyester wrapped around spandex. The yarns that are used to form other portions of the upper, including but not limited to the collar 38 and/or the periphery region 45 may be formed from the same yarn that is used to form the cushioning region 42 (such as first yarn 82 or second yarn 84) or alternatively, the yarn used to form the collar and/or the periphery (or any other portion of the upper) may be formed from a different yarn(s). In an exemplary embodiment, the second yarn 84 is a monofilament strand, such as a polyester monofilament strand.

Figure 8:
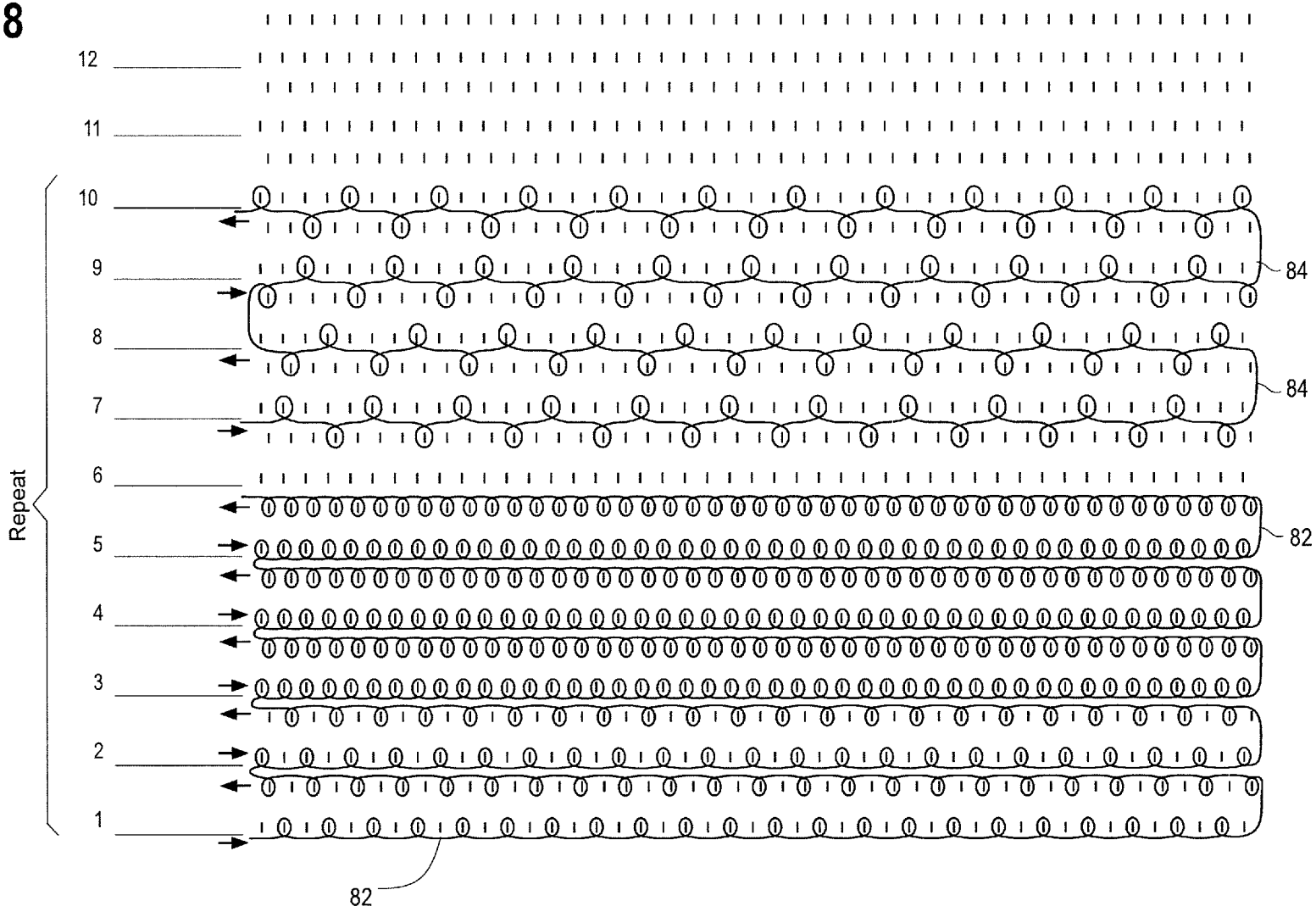
FIG. 8 is a loop diagram for a knit structure of a first portion of the knitted component depicted in FIGS. 5 and 6.
Figure 9:
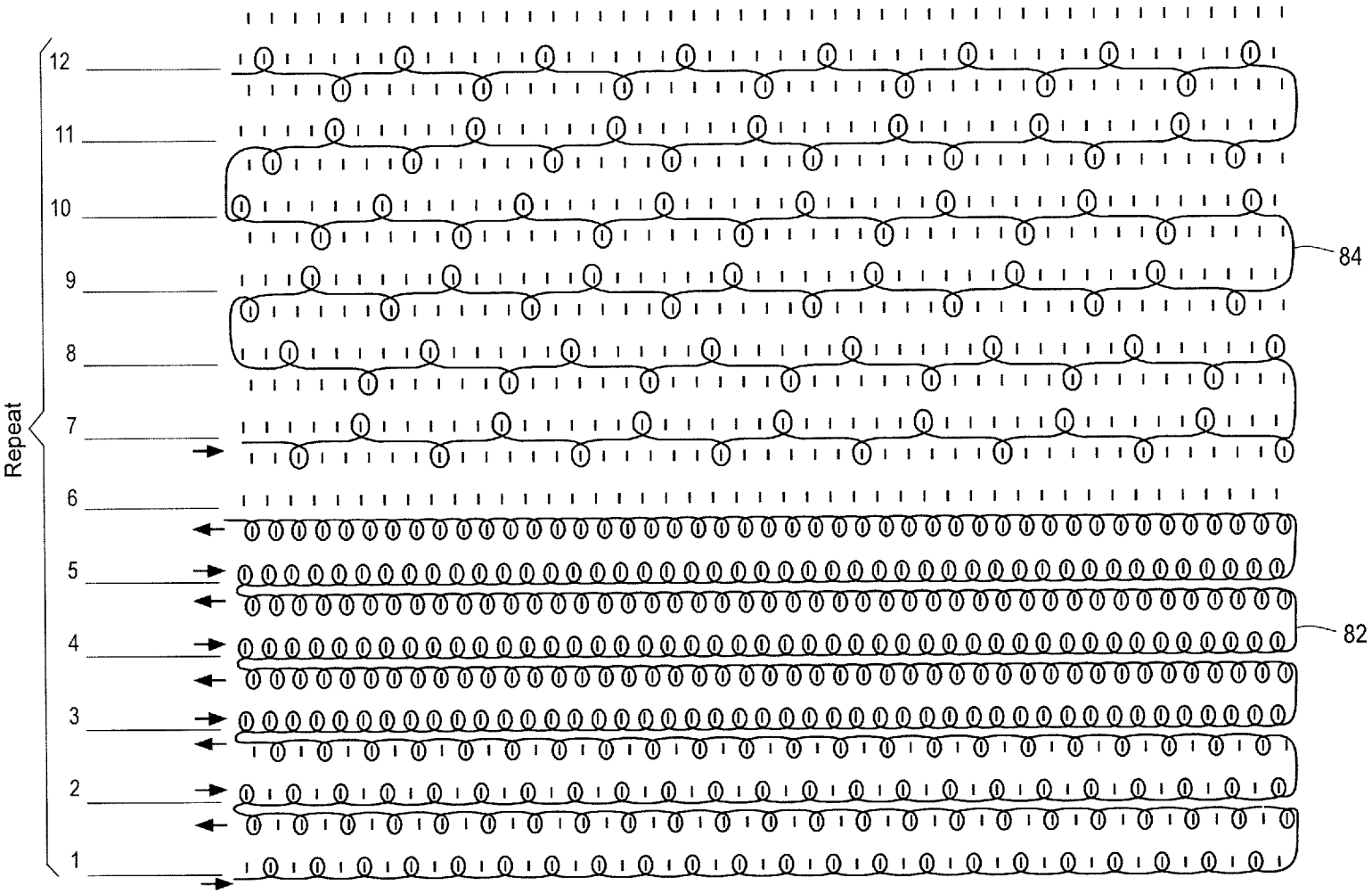
FIG. 9 is a loop diagram for a knit structure of a second portion of the knitted component depicted in FIGS. 5 and 6.
Figure 10:
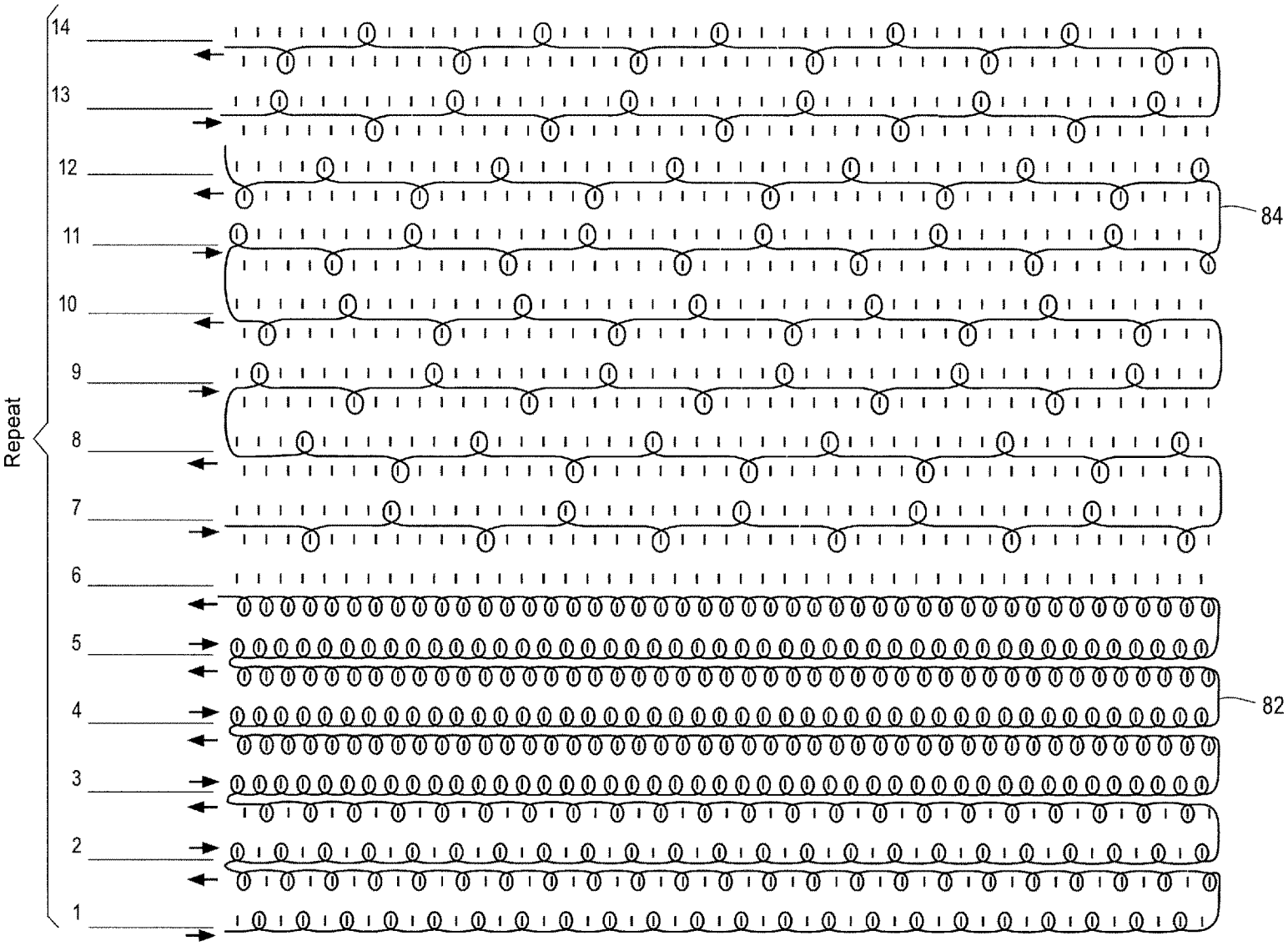
FIG. 10 is a loop diagram for a knit structure of a third portion of the knitted component depicted in FIGS. 5 and 6.

FIG. 8 is a loop diagram for knitting the first set 62 of the knitted cushioning structures 46 of the cushioning region 42. FIG. 9 is a loop diagram for knitting the second set 64 of knitted cushioning structures 46 of the cushioning region 42. FIG. 10 is a loop diagram for knitting the third set 66 of the knitted cushioning structures 46 of the cushioning region 42. The loop diagram illustrated in FIG. 8 depicts one non-limiting example of the construction of the knitted wall 52 of the first set 62 of the knitted cushioning structures 46 which are formed by stitches formed by the first yarn 82 on every needle on a first bed and every needle on a second bed. The stands 56 formed by the second yarn 84 (preferably a monofilament strand) are then extended through the channels 54 and intermittently incorporated into the knit structure that forms the knitted walls 52, such as by a tuck stitch on the first and second needle beds in which each tuck stitch is spaced apart by three needles on a given bed. In other words, in the formation of the first set 62 of the knitted cushioning structures 46 on one needle bed, the second yarn 84 (preferably a monofilament strand) is tucked, then floats three needles, then is tucked again in a repeating pattern on one needle bed. As FIG. 8 shows, the same repeating pattern is occurring on the other needle bed. As also shown in FIG. 8, the tuck stitch on the opposing needle beds may be offset from each other. Stated differently, the tuck occurring on the opposing needle beds is not occurring on needles that directly oppose each other on the respective first and second (e.g., front and back) needle beds. Furthermore, for each consecutive course of strand 56 being knitted, as shown, for example, in rows 7-10 of FIG. 8, the tuck stitch is shifted down one or more needle(s) on each of the front and back needle beds as compared to the previous row. More specifically, the tuck stitch on each of the front and back needle beds in row 8 is shifted down one or more needles as compared to the prior course of row 7. When four strands 56 are utilized to extend through the channel 54 of each of the knitted cushioning structures, it is preferable to knit four courses, with three needles being floated between each tuck on the respective front and back needle beds. In this way, after the completion of all four courses, all (or substantially all) of the needles on each of the front and back beds will have been utilized for a tuck.

The loop diagram illustrated in FIG. 9 depicts the construction of the second set 64 of the knitted cushioning structures 46 of the cushioning region 42. In particular, the knitted walls 52 of the second set 64 of the knitted cushioning structures 46 may be formed by the first yarn 82 on every needle of a first needle bed and by every needle on a second bed. The strands 56 formed by the second yarn 84 (preferably a monofilament strand) are extended through the channels 54 and intermittently incorporated into the knit structure that forms the knitted walls 52 by a tuck stitch on first and second needle beds in which each tuck stitch is spaced apart by five needles on a given bed. In other words, in the formation of the second set 64 of the knitted cushioning structures 46 on one needle bed, the second yarn 84 (preferably a monofilament strand) is tucked, then floats five needles, then is tucked again in a repeating pattern on one needle bed. As FIG. 9 shows, the same repeating pattern is occurring on the other needle bed. As also shown in FIG. 9, the tuck stitch on the opposing needle beds may be offset from each other. Stated differently, the tuck occurring on the opposing needle beds is not occurring on needles that directly oppose each other on the respective first and second (e.g., front and back) needle beds. Furthermore, for each consecutive course of strand 56 being knitted, as shown, for example, in rows 7-12 of FIG. 9, the tuck stitch is shifted down one or more needle(s) on each of the front and back needle beds as compared to the previous row. More specifically, the tuck stitch on each of the front and back needle beds in row 8 is shifted down one or more needles as compared to the position of the tuck of the prior course of row 7. When six strands 56 are utilized to extend through the channel 54 of each of the knitted cushioning structures, it is preferable to knit six courses, with five needles being floated between each tuck on the respective front and back needle beds. In this way, after the completion of all six courses, all (or substantially all) of the needles on each of the front and back beds will have been utilized for a tuck.

The loop diagram illustrated in FIG. 10 depicts the construction of the third set 66 of the knitted cushioning structures 46 of the cushioning region 42. In particular, knitted walls 52 of the third set 66 of the knitted cushioning structures 46 may be formed by the first yarn 82 on every needle of a first needle bed and every needle on a second needle bed. The strands 56 formed by the second yarn 84 (such as a monofilament strand) are then extended through the channels 54 and intermittently incorporated into the knit structure that forms the knitted walls 52 by a tuck stitch on first and second needle beds in which each tuck stitch is spaced apart by seven needles on a given needle bed. In other words, in the formation of the third set 66 of the knitted cushioning structures 46 on one needle bed, the second yarn 84 (preferably a monofilament strand) is tucked, then floats seven needles, then is tucked again in a repeating pattern on one needle bed. As FIG. 10 shows, the same repeating pattern is occurring on the other needle bed. As also shown in FIG. 10, the tuck stitch on the opposing needle beds may be offset from each other. Stated differently, the tuck occurring on the opposing needle beds is not occurring on needles that directly oppose each other on the respective first and second (e.g., front and back) needle beds. Furthermore, for each consecutive course of strand 56 being knitted, as shown, for example, in rows 7-14 of FIG. 10, the tuck stitch is shifted down one or more needle(s) on each of the front and back needle beds as compared to the previous row. More specifically, the tuck stitch on each of the front and back needle beds in row 8 is shifted down one or more needles as compared to the position of the tuck of the prior course of row 7. When eight strands 56 are utilized to extend through the channel 54 of each of the knitted cushioning structures, it is preferable to knit eight courses, with seven needles being floated between each tuck on the respective front and back needle beds. In this way, after the completion of all eight courses, all (or substantially all) of the needles on each of the front and back beds will have been utilized for a tuck.

The knit diagrams shown in FIGS. 8-10 are exemplary representations of one method of constructing the knitted cushioning structures 46 that make up cushioning region 42, although other methods of constructing the knitted cushioning structures 46 may also be utilized as necessary or desired. For example, more or fewer strands 56 may be extended through the channels 54 of the knitted cushioning structures than shown and described above. Further, it is also contemplated that multiple strands 56 of the second yarn 84 may be extended together through the channels 54 of each respective knitted cushioning structure in parallel and/or in bundles of two or more strands that are twisted or braided. In other words, two or more monofilament strands may be treated as a single unit that is knitted in one or more courses through the channels in the manner described above and as shown in FIGS. 8-10

As a person skilled in the art will readily appreciate, the above description is meant as an illustration of the implementation of the principles of this invention. This description is not intended to limit the scope or application of this invention in that the invention is susceptible to modification, variation, and change, without departing from the spirit of this invention as defined in the following claims.

The invention claimed is:

1. An upper for an article of footwear, the upper comprising:

a lateral side a medial side, and a throat area located therebetween, the throat area comprising:

a first set of knitted cushioning structures having a first number of continuous strands extending continuously from the medial side to the lateral side; and a second set of knitted cushioning structures having a second number of continuous strands extending continuously from the medial side to the lateral side, wherein the second number of continuous strands is greater than the first number of continuous strands, wherein each knitted cushioning structure in the first set of knitted cushioning structures and in the second set of knitted cushioning structures is comprised of a knitted wall defining a channel extending from the medial side to the lateral side, wherein each continuous strand of the first number of continuous strands and the second number of continuous strands extends through a respective channel formed by the each knitted cushioning structure, and wherein the second set of knitted cushioning structures provides greater cushioning than the first set of knitted cushioning structures.

2. The upper of claim 1, wherein the knitted cushioning structures are arranged as juxtaposed knitted cushioning structures.

3. The upper of claim 1, wherein the knitted component comprises: a collar defining an opening to a void within the upper for receiving a foot of a wearer, the cushioning region extending outward from the collar; and a peripheral region that extends at least partially around the cushioning region.

4. The upper of claim 1, wherein each channel of the first set of knitted cushioning structures comprises at least two strands extending longitudinally through the channel.

5. The upper of claim 4, wherein the cushioning region further comprises a third set of knitted cushioning structures having a third number of continuous strands extending continuously from the medial side to the lateral side, wherein the third number of continuous strands is greater than the second number of continuous strands, wherein each continuous strand of the third number of continuous strands extends through a respective channel formed by the each knitted cushioning structure in the third set of knitted cushioning structures, wherein the third set of knitted cushioning structures provides greater cushioning than the second set of knitted cushioning structures.

6. The upper of claim 5, wherein the first number of continuous strands is four strands, the second number of continuous strands is six strands, and the third number of continuous strands is eight strands.

7. The upper of claim 6, wherein the third set of knitted cushioning structures is disposed between a first portion and a second portion of the second set of knitted cushioning structures, and wherein a first portion and a second portion of the first set of knitted cushioning structures are disposed adjacent to the first and second portions of the second set of knitted cushioning structures, respectively.

8. The upper of claim 1, wherein the knitted wall comprises a first yarn and the first number and the second number of continuous strands comprise a second yarn.

9. The upper of claim 8, wherein the second yarn is a monofilament yarn.

10. The upper of claim 9, wherein the monofilament yarn is a polyester monofilament yarn.

11. The upper of claim 8, wherein the first yarn comprises two strands of textured polyester wrapped around an elasticated material.

12. The upper of claim 1, wherein the knitted wall is configured as a circular knitted tube wall.

13. The upper of claim 1, wherein the knitted wall is an asymmetric knitted tube wall having an exterior facing wall portion and an interior facing wall portion opposite the exterior facing wall portion.

14. The upper of claim 13, the exterior facing wall portion is configured to form more cushioning volume than the interior facing wall portion.

15. An article of footwear comprising: a sole structure; and an upper secured to the sole structure the upper comprising:

a lateral side and a medial side, the lateral and medial sides being on opposite sides of the upper with a throat region located therebetween, the knitted component comprising:

a cushioning region located between the lateral side and the medial side of the upper, wherein the cushioning region comprises:

a first set of knitted cushioning structures having a first number of continuous strands extending continuously from the medial side to the lateral side; and a second set of knitted cushioning structures having a second number of continuous strands extending continuously from the medial side to the lateral side, wherein the second number of continuous strands is greater than the first number of continuous strands, wherein each knitted cushioning structure in the first set of knitted cushioning structures and the second set of knitted cushioning structures is comprised of a knitted wall defining a channel extending from the medial side to the lateral side, wherein each continuous strand of the first number of continuous strands and the second number of continuous strands extends through a respective channel formed by the each knitted cushioning structure, wherein the second set of knitted cushioning structures provides greater cushioning than the first set of knitted cushioning structures.

16. A method for fabricating an article of footwear, the method comprising:

forming an upper comprising a knitted component, wherein the upper comprises a lateral side and a medial side, the lateral and medial sides being on opposite sides of the upper with a throat region located there between, and wherein forming the upper comprises knitting a plurality of knitted cushioning tubes that define a cushioning region located between the lateral side and medial side of the upper, wherein the cushioning region comprises:

a first set of knitted cushioning tubes having a first number of continuous strands extending continuously from the medial side to the lateral side; and a second set of knitted cushioning tubes having a second number of continuous strands extending continuously from the medial side to the lateral side, wherein the second number of continuous strands is greater than the first number of continuous strands, wherein each knitted cushioning tube in the first set of knitted cushioning tubes and the second set of knitted cushioning tubes is comprised of a knitted wall defining a channel extending from the medial side to the lateral side, wherein each continuous strand of the first number of continuous strands and the second number of continuous strands extends through a respective channel formed by the each knitted cushioning tube, wherein the second set of knitted cushioning tubes provides greater cushioning than the first set of knitted cushioning tubes.

17. The method of claim 16, wherein knitting the plurality of knitted cushioning tubes comprises using a tubular stitch.

* * * * *